US006152408A

United States Patent [19]

O'Grady

[11] Patent Number: 6,152,408

[45] Date of Patent: Nov. 28, 2000

[54] PLASTIC GROCERY BAG OPENING DEVICE

[76] Inventor: David J. O'Grady, P.O. Box 12, Somis, Calif. 93066

[21] Appl. No.: 09/263,281

[22] Filed: Mar. 5, 1999

[51] Int. Cl.[7] ..... B65B 67/04

[52] U.S. Cl. ..... 248/100; 248/99; 383/8; 383/33; 383/34

[58] Field of Search ..... 248/100, 99, 95, 248/101; 383/8, 33, 34

[56] References Cited

U.S. PATENT DOCUMENTS

| | | | |
|---|---|---|---|
| 1,183,124 | 5/1916 | Schwalen | 248/100 |
| 3,724,921 | 4/1973 | Lake | 248/99 X |
| 4,881,706 | 11/1989 | Sedlik | 248/99 |
| 4,998,694 | 3/1991 | Barteaux | 248/100 |
| 5,005,791 | 4/1991 | Lanzen | 248/99 |

*Primary Examiner*—Ramon O. Ramirez
*Assistant Examiner*—A. Joseph Wujciak
*Attorney, Agent, or Firm*—Goldstein & Canino

[57] ABSTRACT

A plastic grocery bag opening device including a back panel securable to an interior surface of a kitchen cabinet door. A pair of side panels are pivotally coupled with the back panel. The pair of side panels each have a generally rectangular configuration defined by a vertical edge, a horizontal edge, and a diagonal edge. The vertical edge and the horizontal edge are essentially planar. The diagonal edge is essentially arcuate. The vertical edge of each side panel is hingedly coupled with opposed side edges of the back panel. The horizontal edge of each side panel has a pair of small arcuate recesses formed therein in a spaced relationship.

1 Claim, 2 Drawing Sheets

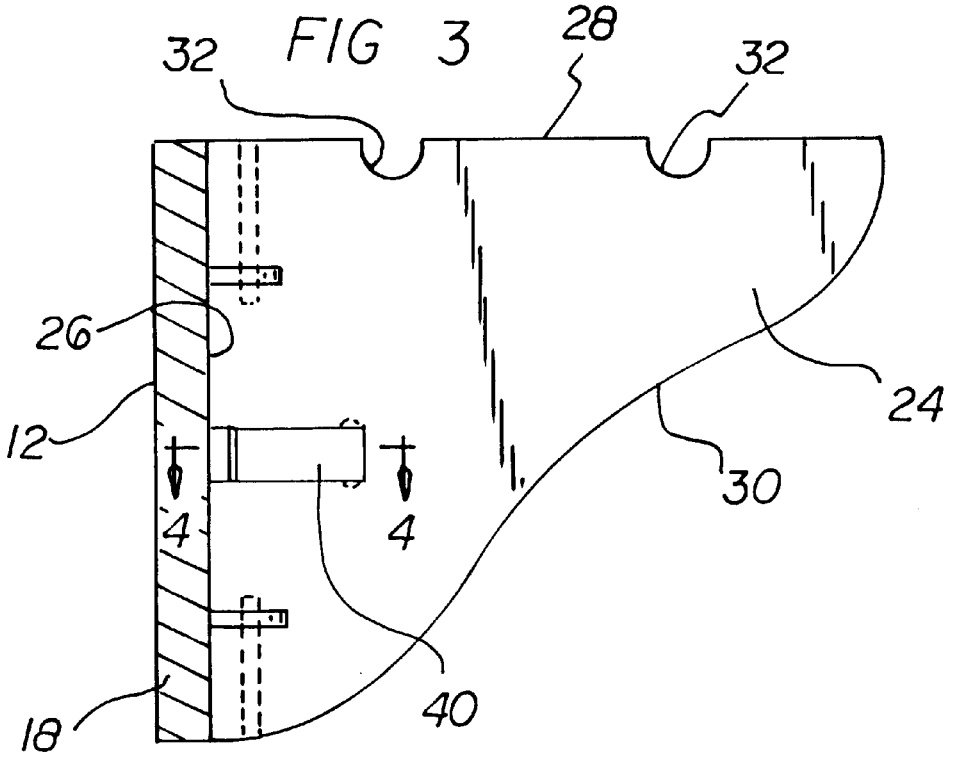
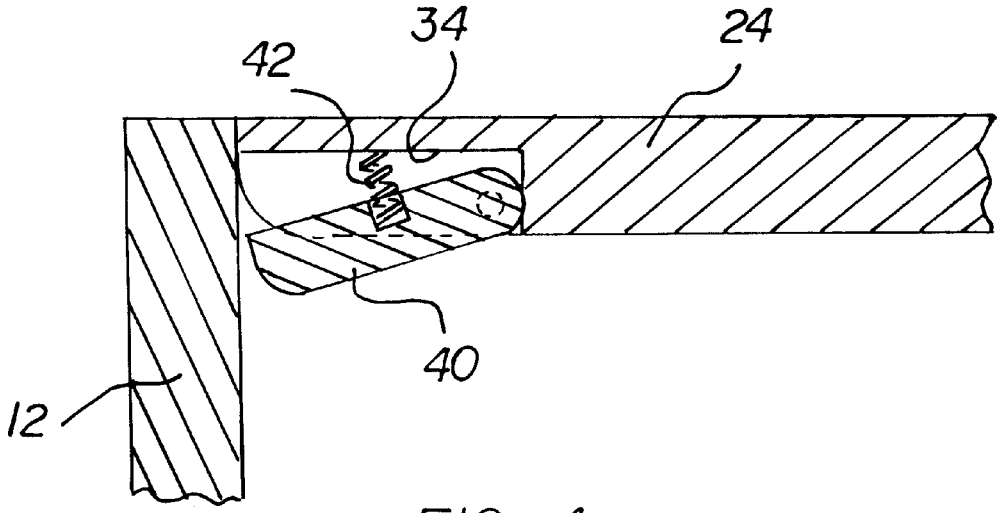
FIG 4

PLASTIC GROCERY BAG OPENING DEVICE

BACKGROUND OF THE INVENTION

The present invention relates to a plastic grocery bag opening device and more particularly pertains to permitting the hanging of a plastic bag received from grocery stores and the like and held open for receiving refuse.

Presently, grocery stores and other type stores provide consumers with a plastic bag with a pair of handles in order to transport their purchases to their homes. Most of the time these bags are thrown out at home because a secondary use is not provided. Some people like to use these bags for their trash. However, these bags are usually too small to be placed within a garbage can whereby the opening in the bag can be held open. These presents a problem in utilizing these bags to their fullest potential. The present invention seeks to provide a solution to this problem. The present invention provides a device that can be secured to an interior of a kitchen cabinet door that can hold a plastic grocery bag open to receive refuse.

The use of bag holding devices is known in the prior art. More specifically, bag holding devices heretofore devised and utilized for the purpose of holding bags open are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, they do not describe a plastic grocery bag opening device for permitting the hanging of a plastic bag received from grocery stores and the like and held open for receiving refuse.

In this respect, the plastic grocery bag opening device according to the present invention substantially departs from the conventional concepts and designs of the prior art, and in doing so provides an apparatus primarily developed for the purpose of permitting the hanging of a plastic bag received from grocery stores and the like and held open for receiving refuse.

Therefore, it can be appreciated that there exists a continuing need for new and improved plastic grocery bag opening device which can be used for permitting the hanging of a plastic bag received from grocery stores and the like and held open for receiving refuse. In this regard, the present invention substantially fulfills this need.

SUMMARY OF THE INVENTION

In the view of the foregoing disadvantages inherent in the known types of bag holding devices now present in the prior art, the present invention provides an improved plastic grocery bag opening device. As such, the general purpose of the present invention, which will be described subsequently in greater detail, is to provide a new and improved plastic grocery bag opening device and method which has all the advantages of the prior art and none of the disadvantages.

To attain this, the present invention essentially comprises a back panel securable to an interior surface of a kitchen cabinet door. The back panel has a rectangular configuration defined by a long upper edge, a long lower edge, and short opposed side edges. The upper edge has a recess formed therein. The back panel has a pair of screw holes therethrough for receiving screws to facilitate securement to the kitchen cabinet door. A pair of side panels are pivotally coupled with the back panel. The pair of side panels each have a generally rectangular configuration defined by a vertical edge, a horizontal edge, and a diagonal edge. The vertical edge and the horizontal edge are essentially planar. The diagonal edge is essentially arcuate. The vertical edge of each side panel is hingedly coupled with the short opposed side edges of the back panel. The horizontal edge of each side panel has a pair of small arcuate recesses formed therein in a spaced relationship. Each side panel has a side recess formed therein extending inwardly from the vertical edges thereof. A pair of pivotable locking members are disposed within the side recesses of the side panels. Each of the locking members are biased outwardly to lock the side panels in an open orientation perpendicular to the back panel by a spring whereby the locking members can be pushed inwardly within the side recesses so as to fold the side panels against the back panel in a closed orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved plastic grocery bag opening device which has all the advantages of the prior art bag holding devices and none of the disadvantages.

It is another object of the present invention to provide a new and improved plastic grocery bag opening device which may be easily and efficiently manufactured and marketed.

It is a further object of the present invention to provide a new and improved plastic grocery bag opening device which is of durable and reliable construction.

An even further object of the present invention is to provide a new and improved plastic grocery bag opening device which is susceptible of a low cost of manufacture with regard to both materials and labor, and which accordingly is then susceptible of low prices of sale to the consuming public, thereby making such a plastic grocery bag opening device economically available to the buying public.

Even still another object of the present invention is to provide a new and improved plastic grocery bag opening device for permitting the hanging of a plastic bag received from grocery stores and the like and held open for receiving refuse.

Lastly, it is an object of the present invention to provide a new and improved plastic grocery bag opening device including a back panel securable to an interior surface of a kitchen cabinet door. A pair of side panels are pivotally coupled with the back panel. The pair of side panels each have a generally rectangular configuration defined by a vertical edge, a horizontal edge, and a diagonal edge. The vertical edge and the horizontal edge are essentially planar. The diagonal edge is essentially arcuate. The vertical edge of each side panel is hingedly coupled with opposed side edges of the back panel. The horizontal edge of each side panel has a pair of small arcuate recesses formed therein in a spaced relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as taken along line 3—3 of FIG. 2.

FIG. 4 is a cross-sectional view of the present invention as taken along line 4—4 of FIG. 3.

The same reference numerals refer to the same parts through the various figures.

DESCRIPTION OF THE PREFERRED EMBODIMENT

Figure 1:
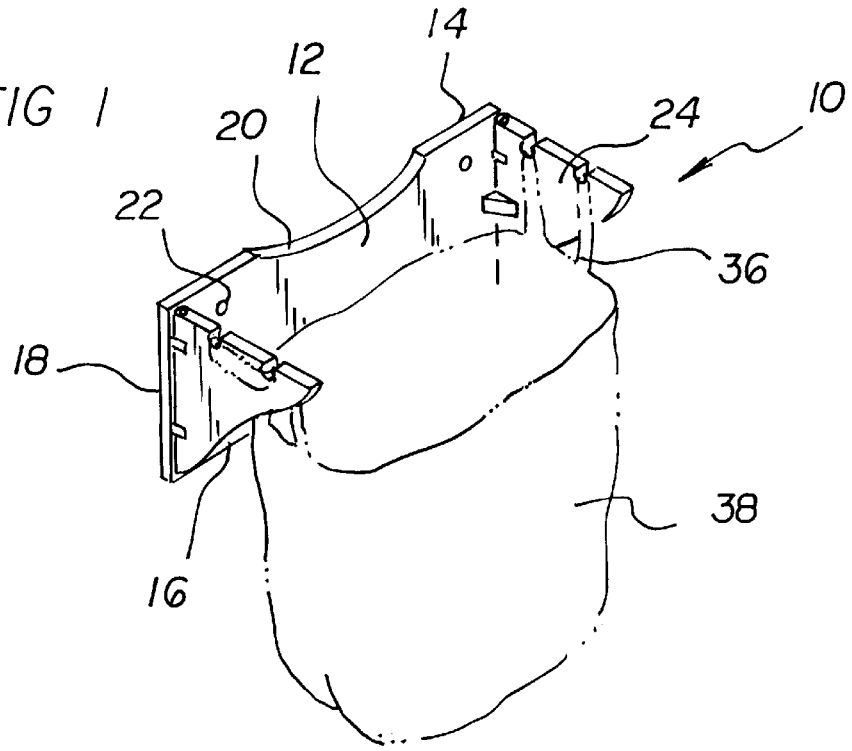
FIG. 1 is a perspective view of the preferred embodiment of the plastic grocery bag opening device constructed in accordance with the principles of the present invention.
Figure 2:
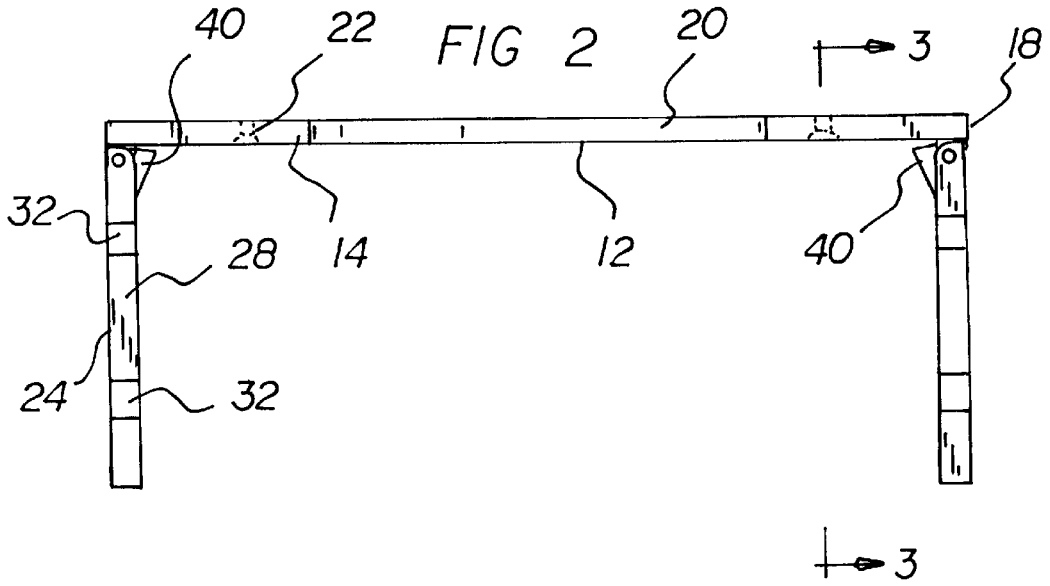
FIG. 2 is a top plan view of the present invention.

With reference now to the drawings, and in particular, to FIGS. 1 through 4 thereof, the preferred embodiment of the new and improved plastic grocery bag opening device embodying the principles and concepts of the present invention and generally designated by the reference number 10 will be described.

Specifically, it will be noted in the various Figures that the device relates to a plastic grocery bag opening device for permitting the hanging of a plastic bag received from grocery stores and the like and held open for receiving refuse. In its broadest context, the device consists of a back panel, a pair of side panels, and a pair of pivotable locking members. Such components are individually configured and correlated with respect to each other so as to attain the desired objective.

The back panel 12 is securable to an interior surface of a kitchen cabinet door. The back panel 12 has a rectangular configuration defined by a long upper edge 14, a long lower edge 16, and short opposed side edges 18. The upper edge 14 has a recess 20 formed therein. The back panel 12 has a pair of screw holes 22 therethrough for receiving screws to facilitate securement to the kitchen cabinet door.

The pair of side panels 24 are pivotally coupled with the back panel 12. The pair of side panels 24 each have a generally rectangular configuration defined by a vertical edge 26, a horizontal edge 28, and a diagonal edge 30. The vertical edge 26 and the horizontal edge 28 are essentially planar. The diagonal edge 30 is essentially arcuate. The vertical edge 26 of each side panel 24 is hingedly coupled with the short opposed side edges 18 of the back panel 12. The horizontal edge 28 of each side panel 24 has a pair of small arcuate recesses 32 formed therein in a spaced relationship. Each side panel 24 has a side recess 34 formed therein extending inwardly from the vertical edges 26 thereof. The small arcuate recesses 32 are dimensioned for receiving opposing sides of inverted U-shaped handles 36 which are disposed on opposing sides of the plastic grocery bag 38. Note FIG. 1. Thus, the bag 38 is held whereby the open upper end thereof is an open orientation.

The pair of pivotable locking members 40 are disposed within the side recesses 34 of the side panels 24. Each of the locking members 40 are biased outwardly to lock the side panels 24 in an open orientation perpendicular to the back panel 12 by a spring 42 (Note FIGS. 2–4) whereby the locking members 40 can be pushed inwardly within the side recesses 34 so as to fold the side panels 24 against the back panel 12 in a closed orientation. The spring 42 will urge the locking member 40 outwardly so that the side panels 24 can not be closed against the back panel 12 thereby causing the disengagement of the bag 38 from the side panels 24.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A plastic grocery bag opening device for permitting the hanging of a plastic bag received from grocery stores and held open for receiving refuse comprising, in combination:

a back panel securable to an interior surface of a kitchen cabinet door, the back panel having a rectangular configuration defined by a long upper edge, a long lower edge, and short opposed side edges, the upper edge having a recess formed therein, the back panel having a pair of screw holes therethrough for receiving screws to facilitate securement to the kitchen cabinet door;

a pair of side panels pivotally coupled with the back panel, the pair of side panels each having a generally rectangular configuration defined by a vertical edge, a horizontal edge, and a diagonal edge, the vertical edge and the horizontal edge being essentially planar, the diagonal edge being essentially arcuate, the vertical edge of each side panel being hingedly coupled with the short opposed side edges of the back panel, the horizontal edge of each side panel having a pair of small arcuate recesses formed therein in a spaced relationship, each side panel having a side recess formed therein extending inwardly from the vertical edges thereof;

a pair of pivotable locking members disposed within the side recesses of the side panels, each of the locking members being biased outwardly to lock the side panels in an open orientation perpendicular to the back panel by a spring whereby the locking members can be pushed inwardly within the side recesses so as to fold the side panels against the back panel in a closed orientation.

* * * * *